US006834929B1

(12) United States Patent
Adams et al.

(10) Patent No.: US 6,834,929 B1
(45) Date of Patent: Dec. 28, 2004

(54) METHOD FOR PRINTING IN NORMAL AND BORDERLESS PRINTING MODES

(75) Inventors: Stephen P. Adams, Lexington, KY (US); Joshua E. Ellingsworth, Lexington, KY (US); Brandon L. Satanek, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/629,188

(22) Filed: Jul. 29, 2003

(51) Int. Cl.[7] ..... B41J 29/393
(52) U.S. Cl. ..... 347/19; 347/14
(58) Field of Search ..... 347/19, 14, 16, 347/37, 101; 400/582, 605, 621, 625, 636, 584, 607, 609

(56) References Cited

U.S. PATENT DOCUMENTS

| | | | | |
|---|---|---|---|---|
| 3,831,478 | A | * | 8/1974 | Wright et al. ..... 83/368 |
| 5,316,396 | A | | 5/1994 | Fukaya |
| 5,731,823 | A | | 3/1998 | Miler et al. |
| 5,795,156 | A | | 8/1998 | Redford et al. |
| 5,872,897 | A | | 2/1999 | Jones et al. |
| 5,992,973 | A | | 11/1999 | Wen |
| 6,109,745 | A | | 8/2000 | Wen |
| 6,275,869 | B1 | | 8/2001 | Sieffert et al. |
| 6,290,327 | B1 | | 9/2001 | Hosokawa et al. |
| 6,414,755 | B1 | | 7/2002 | Bronstein et al. |
| 6,437,876 | B1 | | 8/2002 | Phang et al. |
| 6,450,611 | B1 | | 9/2002 | Brown, Jr. et al. |
| 6,459,471 | B2 | | 10/2002 | Robinson et al. |
| 6,517,180 | B2 | | 2/2003 | Tullis et al. |
| 6,517,267 | B1 | | 2/2003 | Otsuki |
| 2003/0072030 | A1 | | 4/2003 | Haines et al. |
| 2003/0081035 | A1 | | 5/2003 | Van Veen |

* cited by examiner

*Primary Examiner*—Lamson Nguyen
(74) *Attorney, Agent, or Firm*—Douglas Erickson, Esq.

(57) ABSTRACT

One step of the method includes automatically selecting a normal printing mode for printing the image on the sheet when the image can fit within a maximum printable area of the sheet for the normal printing mode, wherein the maximum printable area leaves an unprintable margin from at least one edge of the sheet. Another step includes automatically selecting a borderless printing mode for printing the image on the sheet when the image cannot fit within the maximum printable area, wherein the borderless printing mode leaves no unprintable margin from the at-least-one edge of the sheet. Such steps are performed by at least one computer program.

20 Claims, 3 Drawing Sheets

METHOD FOR PRINTING IN NORMAL AND BORDERLESS PRINTING MODES

TECHNICAL FIELD

The present invention relates generally to printing, and more particularly to a method for printing in normal and borderless printing modes.

BACKGROUND OF THE INVENTION

Printers include, without limitation, computer printers, copiers, and facsimile machines. Some printers, such as inkjet printers, print by printing closely-spaced ink dots on a print medium such as paper. Conventional inkjet printers include those having a carrier with at least one printhead such as a color printhead, a mono printhead, or a photo printhead. Some inkjet printers are controlled by software in a host (e.g., user's) computer, such software including a printing application (such as a word processor or a spreadsheet) for creating a print job, and including a printer driver for printing the print job with a particular make and model of printer.

Conventional inkjet printers have a normal printing mode (or modes) which leave a predetermined minimum unprintable top, bottom, left and right margin on the paper sheet. This allows faster printing and avoids overspray of ink at the edges of the sheet. However, portions of the image extending beyond such unprintable margins are not printed in the normal printing mode(s). Some conventional inkjet printers have a default normal printing mode (or modes) and also have a user-activated borderless printing mode (or modes) which leaves no unprintable margins from two perpendicular edges or from all four edges of the sheet. The borderless printing mode prints at a slower speed than the corresponding normal printing mode and usually enlarges the image so there are no unprintable margins. Typically, to activate the borderless printing mode, the user (after deciding to print a borderless page in a word processor and after clicking the File menu and selecting Print in the word processor) must click the Properties button on the Print dialog to open the printer driver, then must find and turn on the borderless printing mode option in the printer driver, and then must close the printer driver window before printing by selecting Print on the Print dialog. Autocropping algorithms are known for scanning applications residing in the host computer which do not save white spaces surrounding the image and which provide a scanned image to the printer driver for printing on the paper. Manual cropping is also known.

What is needed is an improved method for printing in normal and borderless printing modes.

SUMMARY OF THE INVENTION

A first method of the invention is for printing an image on a sheet of print medium and includes steps a) through c). Step a) includes determining the size of the image. Step b) includes automatically selecting a normal printing mode for printing the image on the sheet when the determined image size can fit within a maximum printable area of the sheet for the normal printing mode, wherein the maximum printable area leaves an unprintable margin from at least one edge of the sheet. Step c) includes automatically selecting a borderless printing mode for printing the image on the sheet when the determined image size cannot fit within the maximum printable area, wherein the borderless printing mode leaves no unprintable margin from the at-least-one edge of the sheet. Steps a) through c) are performed by at least one computer program.

A second method of the invention is for printing an image on a sheet of print medium and includes steps a) through d). Step a) includes determining the size of the image. Step b) includes automatically determining if the determined image size can fit within a maximum printable area of the sheet for a normal printing mode, wherein the maximum printable area is aligned with the sheet and leaves an unprintable margin from each edge of the sheet. Step c) includes automatically selecting the normal printing mode for printing the image on the sheet when the determined image size can fit within the maximum printable area. Step d) includes automatically selecting a borderless printing mode for printing the image on the sheet when the determined image size cannot fit within the maximum printable area, wherein the borderless printing mode leaves no unprintable margin from two perpendicular edges of the sheet. Steps a) through d) are performed by at least one computer program.

A third method of the invention is for printing an image on a sheet of print medium and includes steps a) and b). Step a) includes automatically selecting a normal printing mode for printing the image on the sheet when the image can fit within a maximum printable area of the sheet for the normal printing mode, wherein the maximum printable area leaves an unprintable margin from at least one edge of the sheet. Step b) includes automatically selecting a borderless printing mode for printing the image on the sheet when the image cannot fit within the maximum printable area, wherein the borderless printing mode leaves no unprintable margin from the at-least-one edge of the sheet. Steps a) and b) are performed by at least one computer program.

Several benefits and advantages are derived from one or more of the methods of the invention. By automatically selecting the borderless printing mode when, and only when, the image will not fit within the maximum printable area of the normal printing mode, borderless printing is provided to inexperienced users unfamiliar with the added steps to manually activate borderless printing and saves the experienced user from having to take such added steps.

DETAILED DESCRIPTION

Figure 1:
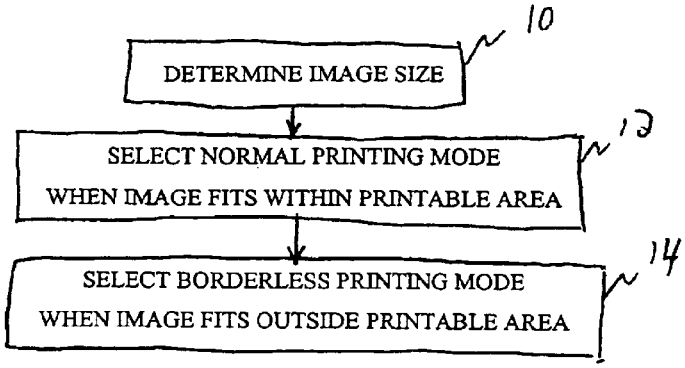
FIG. 1 is a block diagram of a first method of the invention for printing an image on a sheet of print medium.
Figure 2:
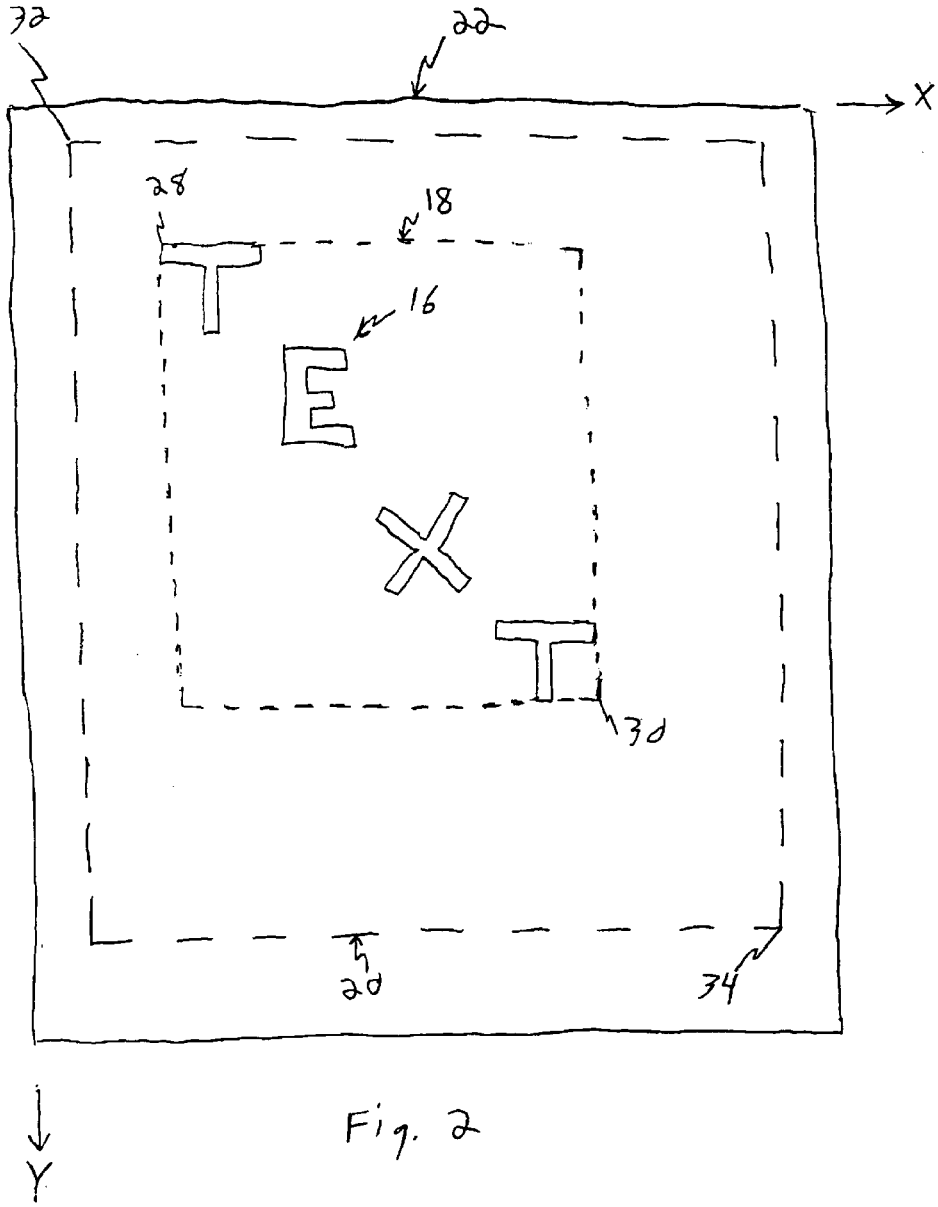
FIG. 2 is an illustration of a comparison of a smallest size rectangle that can contain a particular text image and a rectangular maximum printable area, such illustration used in describing an example of the first method of FIG. 1, and such illustration representing pictorially a comparison of the text image size and the maximum printable area which is performed by at least one computer program.
Figure 3:
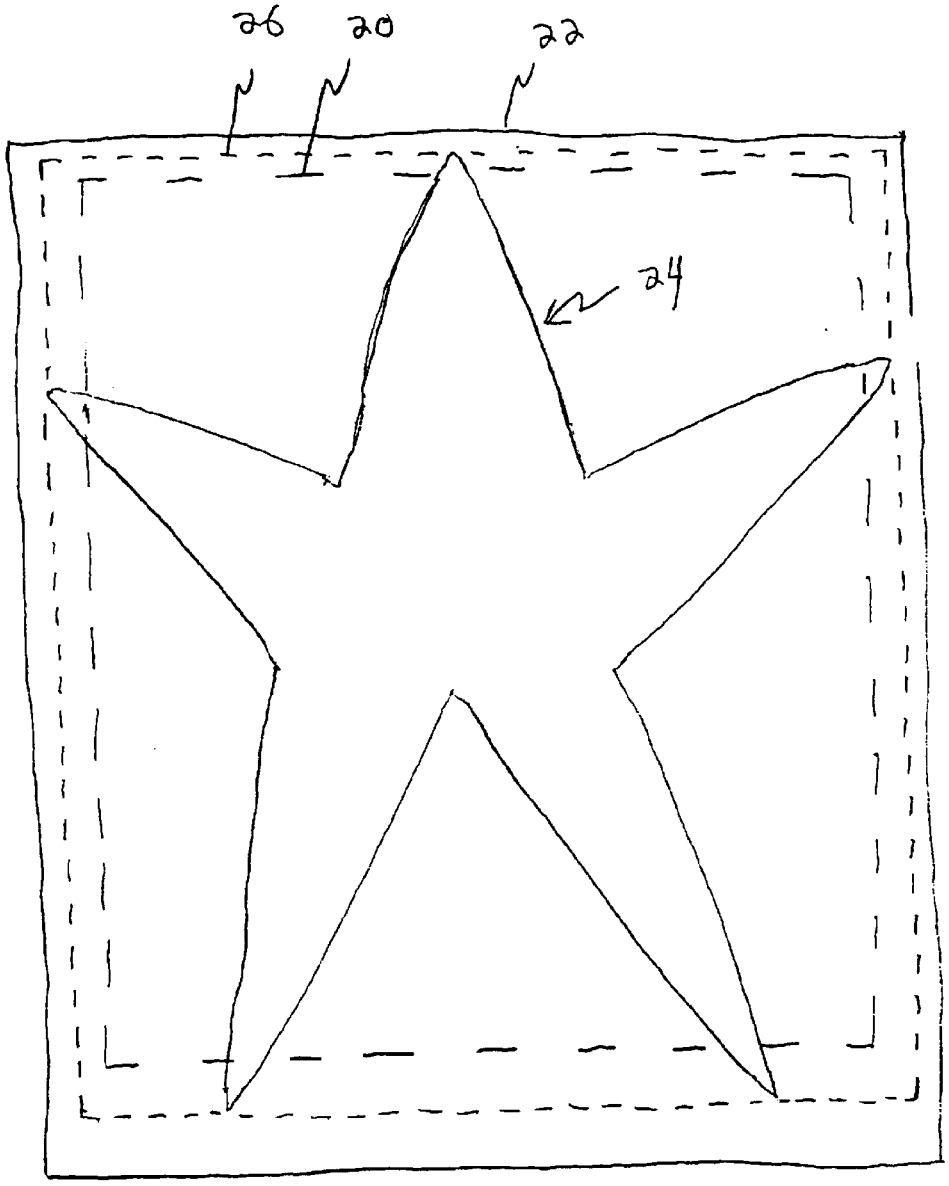
FIG. 3 is an illustration, as in FIG. 2, but with a different image which is a non-text image.

Referring to FIGS. 1–3, a first method of the invention is for printing an image on a sheet of print medium and includes steps a) through c). Step a) is labeled as "Determine Image Size" in block 10 of FIG. 1. Step a) includes determining the size of the image (meaning the size of the image to be printed not including any empty margins). Step b) is labeled as "Select Normal Printing Mode When Image Fits Within Printable Area" in block 12 of FIG. 1. Step b) includes automatically selecting a normal printing mode for printing the image on the sheet when the determined image size can fit within a maximum printable area of the sheet for the normal printing mode, wherein the maximum printable area leaves an unprintable margin from at least one edge of the sheet. Step c) is labeled as "Select Borderless Printing Mode When Image Fits Outside Printable Area" in block 14 of FIG. 1. Step c) includes automatically selecting a borderless printing mode for printing the image on the sheet when the determined image size cannot fit within the maximum printable area, wherein the borderless printing mode leaves no unprintable margin from the at-least-one edge of the sheet. Steps a) through c) are performed by at least one computer program. Steps b) and c) can be performed in any order.

In the example of FIG. 2, the image within the computer program is a text image 16 pictorially represented in FIG. 2 by the letters "T E X T". In this example, the image size determined by the computer program is pictorially represented by the dashed-line rectangle 18, and the maximum printable area, which is known to the at-least-one computer program, is pictorially represented by the dashed-line rectangle 20. To help orient the reader, the sheet size is shown in FIG. 2 as the solid-line rectangle 22, such sheet size not being needed by the at-least-one computer program for steps a) through c) other than to determine what maximum printable area to use based on the sheet size to be used for the actual printing. A normal printing mode would be automatically selected by the at-least-one computer program for the example of FIG. 2 as the image fits within the maximum printable area. It is noted that some algorithms do use sheet size for steps a) through c).

The example of FIG. 3 depicts the same size solid-line rectangle 22 representing the sheet size and the same size dashed-line rectangle 20 representing the maximum printable area as in FIG. 2. However, in FIG. 3, the image is a non-text image 24 pictorially represented in FIG. 3 by a five-pointed star. The image size is represented by the dashed-line rectangle 26. A borderless printing mode would be automatically selected by the at-least-one computer program for the example of FIG. 3 as the image does not fit within the maximum printable area.

In one enablement of the first method, the sheet is a rectangular sheet, wherein the image size is defined as the smallest size image rectangle that is aligned with the sheet and can contain the image, and wherein the maximum printable area is a rectangular maximum printable area aligned with the sheet. In one variation, the image size in step a) is defined by the corner locations of a pair of diagonally-opposite corners of the smallest size image rectangle. This is shown in the example of FIG. 2, wherein corners 28 and 30 are shown as diagonally-opposite corners of rectangle 18. In the same or a different variation, the rectangular maximum printable area is defined by the corner locations of a pair of corresponding diagonally-opposite corners of the rectangular maximum printable area. This is shown in the example of FIG. 2, wherein corners 32 and 34 of rectangle 20 are the diagonally-opposite corners corresponding to corners 28 and 30. In one modification, there is also included the step of determining whether the determined image size can fit within the rectangular maximum printable area from the defined corner locations.

In one algorithm, referring to FIG. 2, the corners are represented by X,Y coordinates, wherein the top left corner of the sheet is represented by X=0 and Y=0, wherein X increases positively toward the right, and wherein Y increases positively toward the bottom. Here, X(28) represents the X coordinate of corner 28, Y(28) represents the Y coordinate of corner 28, X(30) represents the X coordinate of corner 30, etc. A borderless printing mode is automatically selected if any of the following is true: X(28) is less than X(32); Y(28) is less than Y(32); X(30) is greater than X(34); or Y(30) is greater than Y(34). Otherwise, a normal printing mode is automatically selected.

In one arrangement, the maximum printable area leaves an unprintable margin from at least two edges of the sheet. In one variation, the maximum printable area leaves an unprintable margin from each of the edges of the sheet. In one embodiment, the normal printing mode and the borderless printing mode are printing modes of an inkjet printer. It is noted that a printer may have more than one normal printing mode and/or more than one borderless printing mode. In one construction, the automatically selecting of steps b) and c) is for use in printing from a computer printer, a copier, a facsimile machine, or an all-in-one machine which at least prints and copies.

In one employment of the first method, the fastest printing speed of the borderless printing mode is slower than the fastest printing speed of the normal printing mode. In one variation, the borderless printing mode includes enlarging the image size so that step c) leaves no unprintable margin from the at-least-one edge of the sheet. In one usage, the image in step a) is a non-scanned image. In another usage, the image in step a) is an autocropped scanned image. In a further usage, the image in step a) is a user-cropped portion of a scanned photographic image.

Figure 4:
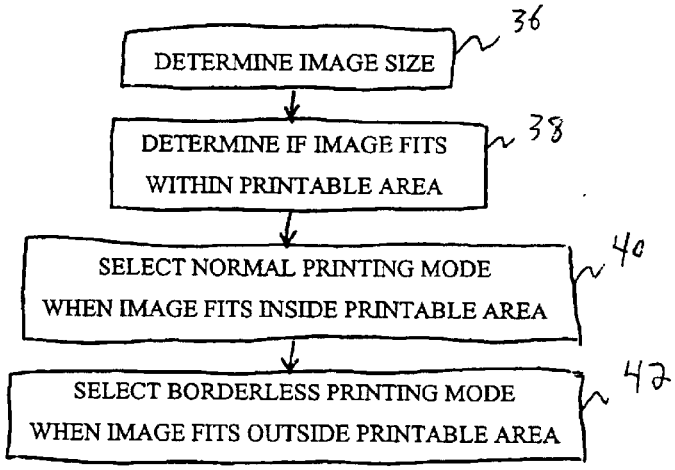
FIG. 4 is a block diagram of a second method of the invention.

A second method of the invention is for printing an image on a sheet of print medium and includes steps a) through d). Step a) is labeled as "Determine Image Size" in block 36 of FIG. 4. Step a) includes determining the size of the image. Step b) is labeled as "Determine If Image Fits Within Printable Area" in block 38 of FIG. 4. Step b) includes automatically determining if the determined image size can fit within a maximum printable area of the sheet for a normal printing mode, wherein the maximum printable area is aligned with the sheet and leaves an unprintable margin from each edge of the sheet. Step c) is labeled as "Select Normal Printing Mode When Image Fits Inside Printable Area" in block 40 of FIG. 4. Step c) includes automatically selecting the normal printing mode for printing the image on the sheet when the determined image size can fit within the maximum printable area. Step d) is labeled in as "Select Borderless Printing Mode When Image Fits Outside Printable Area" in block 42 of FIG. 4. Step d) includes automatically selecting a borderless printing mode for printing the image on the sheet when the determined image size cannot fit within the maximum printable area, wherein the borderless printing mode leaves no unprintable margin from two perpendicular edges of the sheet. Steps a) through d) are performed by at least one computer program. Steps c) and d) can be performed in any order.

In one example of the second method, the image is a non-scanned image, and a printing application computer program (i.e., a program which creates pages and passes them to the printer driver software for printing) in a host (e.g., user's) computer performs steps a) through d). In another example, the image in step a) is a scanned image, a scanning application computer program (i.e., a program which allows images to be scanned in from a scanning device into memory) in a host computer scans the image into memory of the host computer, and an autocropping algorithm in the host computer eliminates empty margins of the scanned image.

Figure 5:
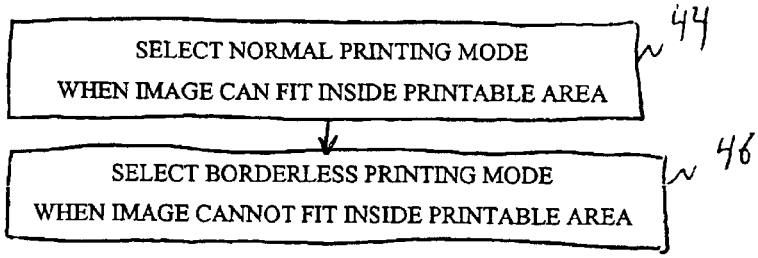
FIG. 5 is a block diagram of a third method of the invention.

A third method of the invention is for printing an image on a sheet of print medium and includes steps a) and b). Step a) is labeled as "Select Normal Printing Mode When Image Can Fit Inside Printable Area" in block 44 of FIG. 5. Step a) includes automatically selecting a normal printing mode for printing the image on the sheet when the image can fit within a maximum printable area of the sheet for the normal printing mode, wherein the maximum printable area leaves an unprintable margin from at least one edge of the sheet. Step b) is labeled as "Select Borderless Printing Mode When Image Cannot Fit Inside Printable Area: in block 46 of FIG. 5. Step b) includes automatically selecting a borderless printing mode for printing the image on the sheet when the image cannot fit within the maximum printable area, wherein the borderless printing mode leaves no unprintable margin from the at-least-one edge of the sheet. Steps a) and b) are performed by at least one computer program. Steps a) and b) can be performed in any order.

In one example of the third method, the image is a non-scanned image, and a printing application computer program (i.e., a program which creates pages and passes them to the printer driver software for printing) in a host (e.g., user's) computer performs steps a) and b). In another example, the image in step a) is a scanned image, a scanning application computer program (i.e., a program which allows images to be scanned in from a scanning device into memory) in a host computer scans the image into memory of the host computer, and an autocropping algorithm in the host computer eliminates empty margins of the scanned image.

It is noted that an all-in-one application on a host computer combines the functionality of a scanning application computer program and a printing application computer program. Whether separate or combined applications, for any or all of the above-described methods, for a scanned image, a full scan of the object on the scanner glass must be performed to determine the need for borderless printing. This scan can be either a low-resolution preview scan or a high-resolution content scan. In one example, the image scanned into memory is analyzed by passing it through an autocropping algorithm which ignores white space and background noise. The autocropping algorithm determines the corner locations X(28),Y(28) and X(30),Y(30) which is used by the printing application which contains the previously-described inventive steps to automatically determine the need for a borderless printing mode. For a non-scanned image, in one example, the printing application contains the previously-described inventive steps, wherein the size of the image is determined from the image in memory from its width in pixels and height in pixels divided by its resolution in dots per inch. In an all-in-one machine, a non-scanned image can optionally be processed through an autocropping algorithm as previously described for a scanned image.

The standard method of communicating a conventional user-activated borderless printing mode between a printing application and the printer driver is through the devmode data structure which has both a private and a public set of data. The public data is defined by Microsoft® Windows® and is common for all printer devices. The private data is unique to each printer or printer manufacturer.

One technique for any printing application to indicate the automatic selection of borderless printing to the printer driver uses the public devmode as follows. The printing application does not list borderless paper sizes in its available paper size list by not listing any paper size that has its margins reported as 0. If borderless printing has been automatically selected, and the selected paper size also has a borderless counterpart, the printing application will change the dmPaperSize field in the public devmode to the borderless size. Prior to the job being sent to the printer driver. To determine if a given paper size has a borderless counterpart, the printing application will enumerate all of the available paper sizes for the printer and search for a listing that has the same physical dimensions as the selected paper size, but margins of 0. If a borderless counterpart listing of the selected paper size is found, then the dmPaperSize field of the public devmode is modified to represent the manufacturer-defined, borderless paper size. Thus, when the printer driver examines the devmode associated with the print job, a borderless paper size will be correctly set in the dmPaperSize field and the job will be formatted as borderless.

One technique for any printing application to indicate the automatic selection of borderless printing to the printer driver uses the private devmode as follows. The private devmode is defined such that it contains a borderless printing on/off field. The printing application uses the borderless field in the private devmode to indicate borderless printing.

In one option, the logic of one or more methods of the invention is placed into the printer driver. However, the processing required to perform the analysis as data is being configured for the printing device would slow printing on current computer systems. In another option, for a printing device having standalone capabilities, the logic of one or more methods of the invention is placed into the printing device. In one variation, such logic is placed into the processor of an all-in-one standalone device which includes a printer and includes a scanner for copying.

Several benefits and advantages are derived from one or more of the methods of the invention. By automatically selecting the borderless printing mode when, and only when, the image will not fit within the maximum printable area of the normal printing mode, borderless printing is provided to inexperienced users unfamiliar with the added steps to manually activate borderless printing and saves the experienced user from having to take such added steps.

The foregoing description of several methods of the invention has been presented for purposes of illustration. It is not intended to be exhaustive or to limit the invention to the precise procedures and forms disclosed, and obviously many modifications and variations are possible in light of the above teaching. It is intended that the scope of the invention be defined by the claims appended hereto.

What is claimed is:

1. A method for printing an image on a sheet of print medium comprising the steps of:

a) determining the size of the image;

b) automatically selecting a normal printing mode for printing the image on the sheet when the determined image size can fit within a maximum printable area of the sheet for the normal printing mode, wherein the maximum printable area leaves an unprintable margin from at least one edge of the sheet; and c) automatically selecting a borderless printing mode for printing the image on the sheet when the determined image size cannot fit within the maximum printable area, wherein the borderless printing mode leaves no unprintable margin from the at-least-one edge of the sheet, wherein steps a) through c) are performed by at least one computer program.

2. The method of claim 1, wherein the sheet is a rectangular sheet, wherein the image size is defined as the smallest size image rectangle that is aligned with the sheet and can contain the image, and wherein the maximum printable area is a rectangular maximum printable area aligned with the sheet.

3. The method of claim 2, wherein the image size in step a) is defined by the corner locations of a pair of diagonally-opposite corners of the smallest size image rectangle.

4. The method of claim 3, wherein the rectangular maximum printable area is defined by the corner locations of a pair of corresponding diagonally-opposite corners of the rectangular maximum printable area.

5. The method of claim 4, also including the step of determining whether the determined image size can fit within the rectangular maximum printable area from the defined corner locations.

6. The method of claim 2, wherein the maximum printable area leaves an unprintable margin from at: least two edges of the sheet.

7. The method of claim 6, wherein the maximum printable area leaves an unprintable margin from each of the edges of the sheet.

8. The method of claim 1, wherein the normal printing mode and the borderless printing mode are printing modes of an inkjet printer.

9. The method of claim 8, wherein the automatically selecting of steps b) and c) is for use in printing from a computer printer, a copier, a facsimile machine, or an all-in-one machine which at least prints and copies.

10. The method of claim 1, wherein the fastest printing speed of the borderless printing mode is slower than the fastest printing speed of the normal printing mode.

11. The method of claim 10, wherein the borderless printing mode includes enlarging the image size so that step c) leaves no unprintable margin from the at-least-one edge of the sheet.

12. The method of claim 1, wherein the image in step a) is a non-scanned image.

13. The method of claim 1, wherein the image in step a) is an autocropped scanned image.

14. The method of claim 1, wherein the image in step a) is a user-cropped portion of a scanned photographic image.

15. A method for printing an image on a sheet of print medium comprising the steps of:

a) determining the size of the image;

b) automatically determining if the determined image size can fit within a maximum printable area of the sheet for a normal printing mode, wherein the maximum printable area is aligned with the sheet and leaves an unprintable margin from each edge of the sheet;

c) automatically selecting the normal printing mode for printing the image on the sheet when the determined image size can fit within the maximum printable area; and d) automatically selecting a borderless printing mode for printing the image on the sheet when the determined image size cannot fit within the maximum printable area, wherein the borderless printing mode leaves no unprintable margin from two perpendicular edges of the sheet, wherein steps a) through d) are performed by at least one computer program.

16. The method of claim 15, wherein the image is a non-scanned image, and wherein a printing application computer program in a host computer performs steps a) through d).

17. The method of claim 15, wherein the image in step a) is a scanned image, wherein a scanning application computer program in a host computer scans the image into memory of the host computer, and wherein an autocropping algorithm in the host computer eliminates empty margins of the scanned image.

18. A method for printing an image on a sheet of print medium comprising the steps of:

a) automatically selecting a normal printing mode for printing the image on the sheet when the image can fit within a maximum printable area of the sheet for the normal printing mode, wherein the maximum printable area leaves an unprintable margin from at least one edge of the sheet; and b) automatically selecting a borderless printing mode for printing the image on the sheet when the image cannot fit within the maximum printable area, wherein the borderless printing mode leaves no unprintable margin from the at-least-one edge of the sheet, wherein steps a) and b) are performed by at least one computer program.

19. The method of claim 18, wherein the image is a non-scanned image, and wherein a printing application computer program in a host computer performs steps a) through d).

20. The method of claim 18, wherein the image in step a) is a scanned image, wherein a scanning application computer program in a host computer scans the image into memory of the hose computer, and wherein an autocropping algorithm in the host computer eliminates empty margins of the scanned image.

* * * * *